United States Patent [19]

Donovan

[11] Patent Number: 4,508,513

[45] Date of Patent: Apr. 2, 1985

[54] GAME CARD DEVICE

[75] Inventor: John Donovan, Hatfield Peverel, England

[73] Assignee: Don Marketing Ltd., Essex, England

[21] Appl. No.: 565,610

[22] Filed: Dec. 27, 1983

[30] Foreign Application Priority Data

Jan. 7, 1983 [GB] United Kingdom ..... 8300440
Jul. 20, 1983 [GB] United Kingdom ..... 8319631

[51] Int. Cl.[3] ..... G09B 3/08
[52] U.S. Cl. ..... 434/346; 273/139
[58] Field of Search ..... 273/139; 439/328, 346; 283/100–105, 903

[56] References Cited

U.S. PATENT DOCUMENTS 3,918,174 11/1975 Miller et al. ..... 434/346
4,095,824 6/1978 Bachman ..... 273/139 X
4,241,943 12/1980 Malinovitz ..... 283/901 X
4,429,877 2/1984 Coppock ..... 273/139
4,466,614 8/1984 Bachman et al. ..... 434/346 X

FOREIGN PATENT DOCUMENTS 2085308 4/1982 United Kingdom ..... 283/903

*Primary Examiner*—Paul E. Shapiro
*Attorney, Agent, or Firm*—Parkhurst & Oliff

[57] ABSTRACT

The invention relates to a game card device 1 comprising a manually held card 2 which has first, second and third indicia 3, 4 and 5 all of which have spaces which are covered by a camouflaging layer of rubber/graphite mixture which can be removed readily by rubbing or scratching. The first indicia 3 indicates a first category or field of activity, the second 4 indicia identifies a number of different integers associated with the first indicia 3 and the third indicia 5 provides a plurality of separate options associated with a combination of the first and second indicia 3 and 4 whereby to match them using skill.

11 Claims, 4 Drawing Figures

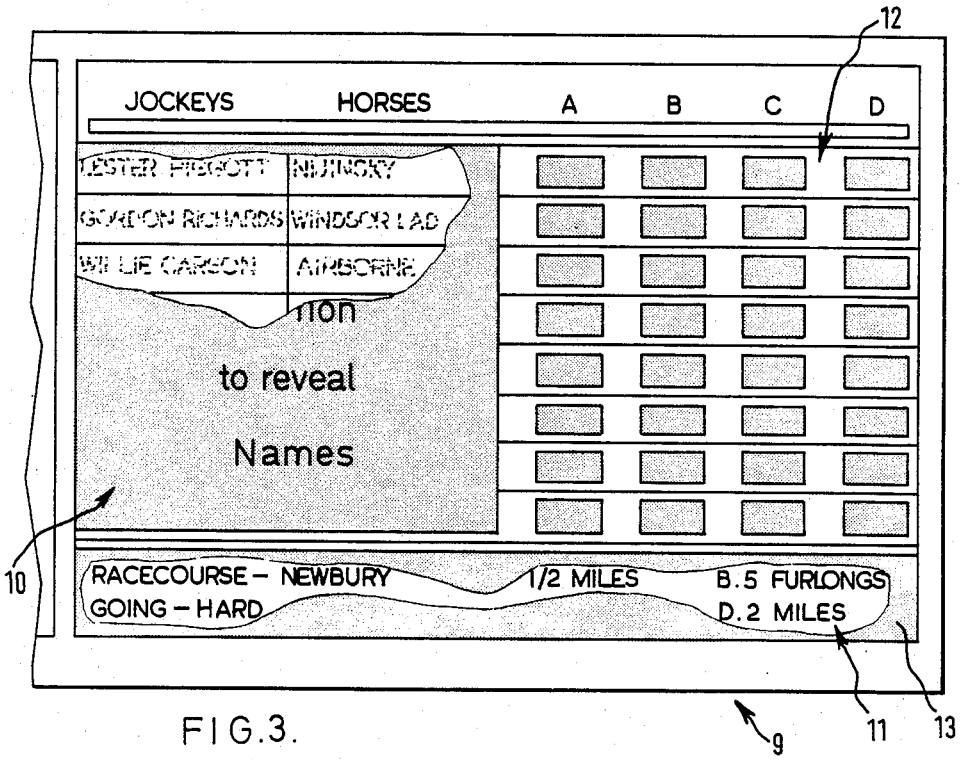
FIG.3.
FIG.4.
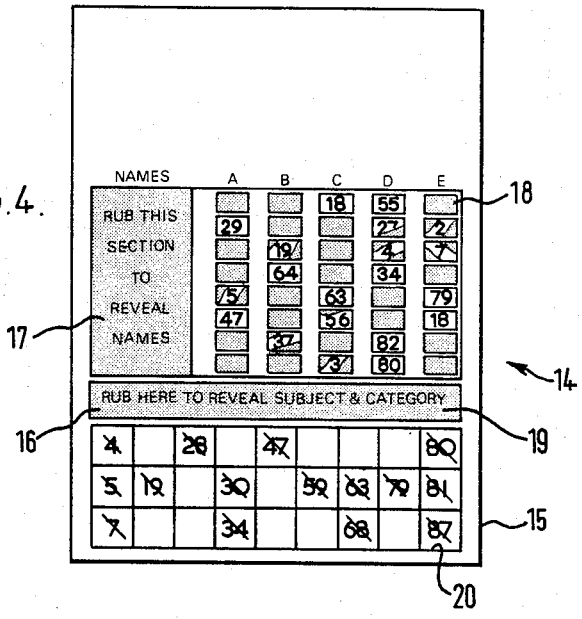

GAME CARD DEVICE

The invention relates to a game card device, particularly of the kind which is used for promotional and/or educational or amusement purposes and is in the form of a card bearing a game of skill.

According to the invention there is provided a game card device, for participating in a game of skill, comprising first, second and third indicia, the first indicia identifying a category or field of activity, the second indicia identifying a number of different integers associated with the first indicia, and the third indicia providing a plurality of separate options associated with an association of the first and second indicia, all of the indicia being camouflaged by an opaque layer which is removable from the first, second and third indicia individually whereby to reveal selected parts thereof.

The layer may be removable from the whole of the first and second indicia prior to being removed from the third indicia.

The said layer may be removable selectively from the third indicia to reveal only selected parts thereof.

The second indicia may itself comprise a plurality of different but associated indicia, for example the names of jockeys and horses which could be ridden by the jockeys.

There may be a fourth indicia which is not covered by the camouflaging layer and which may be associated with the third indicia. Thus the fouth indicia may be a printed grid bearing numbers and the third indicia may comprise a plurality of numbers so that a "bingo" type game can be played using the game card device according to the invention.

The second indicia may comprise a column of eight spaces each bearing the name of separate but related entities and the third indicia may comprise a plurality of separate columns of indicia parallel to the first-mentioned column for indicating whether the first indicia and second indicia have been associated correctly.

The third indicia may comprise a plurality of spaces in each column which may be aligned with the spaces of the second column and each of which may bear one of two game result options. Thus the option may be "win or "lose".

The third indicia may comprise a plurality of spaces in each column which may be aligned with the spaces of the second column and bearing a number.

The third device may comprise a plurality of spaces in each column which may be aligned with the spaces of the second column and each bearing a monetary value.

The camouflaging layer may comprise a mixture of rubber and graphite secured to a face of the card device as by heat treatment temporarily to conceal the indicia until removed therefrom as by scratching or rubbing.

The game and device of the invention provides a game of skill, not chance, participants being required to exercise skill and judgement to discover whether they can correctly correlate the information given by three indicia.

Game card devices embodying the invention are hereinafter described, by way of example, with reference to the accompanying drawings.

BRIEF DESCRIPTION OF DRAWINGS

FIG. 3 shows a plan view of part of the front of a second game card device, to a larger scale than that of FIGS. 1 and 2, in which part of the camouflaging layer has been erased for clarity; and FIG. 4 is a plan view of part of the front of a third game card device according to the invention;

Figure 1:
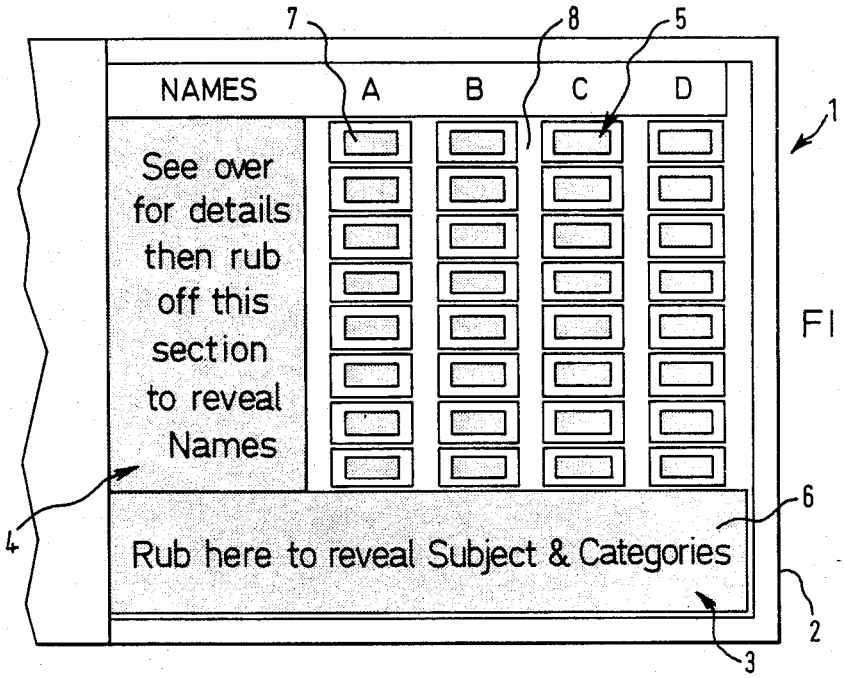
FIG. 1 is a plan view of part of the front of a game card device before play of the game commences.
Figure 2:
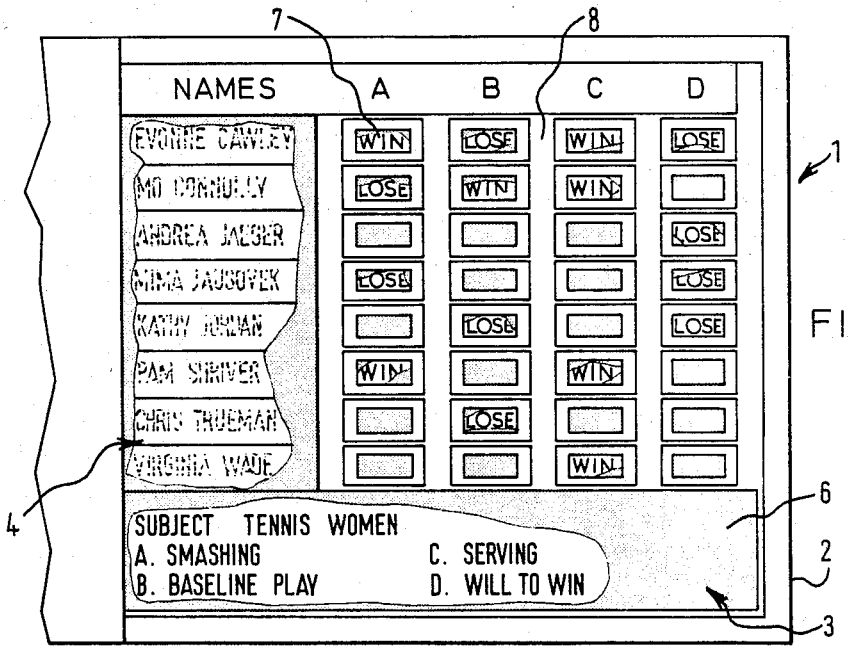
FIG. 2 shows the game card device of FIG. 1 after the game is played.

Referring firstly to FIGS. 1 and 2, the game card device 1 shown comprises a cardboard, plastics or other material substratum or rectangular card 2 which can be held in the hand and to which is applied as by printing first, second and third indicia 3, 4 and 5 all of which have spaces which are covered by a removable camouflaging layer 6 in the form of a rubber/graphite mixture which is adhered to the face of the card 2 as by a heat treatment process but which can readily be removed therefrom with say a finger-nail or edge of a coin.

The first indicia 3 identifies a particular field of activity, in this case particular skills required in the game of tennis. The second indicia 4 identifies a number of different integers in the form of a list of women tennis players so that those players are associated with the first indicia or field of activity 3. The third indicia 5 provides a plurality of separate options associated with each of the second indicia 4. In the embodiment shown, the third indicia 5 comprises four separate columns labelled "A", "B", "C" and "D" respectively, each column having a "win" or "lose" option associated with a particular player of the second indicia 4 and comprising in the embodiment shown eight spaced arranged vertically as viewed so that each "entry" in column "A", "B", "C" or "D" is opposite a respective one of the eight names in the second indicia 4. Each name or entry of the second indicia 4 is thus aligned horizontally as viewed with four of the third indicia 5 one in each of columns "A", "B", "C" and "D". The first indicia 3 has four spaces or categories and the second and third indicia have eight spaces. The columns A, B, C and D of the third indicia 5 correspond too with the different particular skills the subject of the first indicia 3; in the embodiment, "A" corresponds with smashing, "B" baseline play, "C" serving, "D" will to win.

Substantially the whole of the playing surface of the card device is covered by the camouflaging layer, on which the relevant instructions are printed, the columns "A", "B", "C" and "D" being covered by individual strips of layer 6.

In order to play the game of skill using the game card device, the player takes the device of FIG. 1 and removes the camouflaging layer 6 from the first and second indicia 3 and 4, using a fingernail or the edge of a coin, following the instructions as shown.

The game card device 1 illustrated is concerned with the game of tennis as shown in FIG. 2 where the first and second indicia 3 and 4 are shown revealed.

The player then has to select some, in this case four, options in Column "A" of the third indicia 5 by removing the camouflaging layer from a space in column "A" opposite a particular name in indicia 4. Each space of the third indicia 5 is indicated on the camouflaging layer by a rectangle printed on the layer 6. If the player thinks that Evonne Cawley is good at smashing, he removes the layer 6 from the space 7 opposite that name in column "A". If the player is correct, the removed layer reveals the caption WIN or some equivalent caption. If the player is wrong, the word "LOSE" or the like will be revealed. These results are shown at 7 and 8 in FIG.

2. The player then proceeds to Column "B" to exercise skill in deciding which of the names corresponds with good base-line play in tennis. The player can then move on to Columns "C" and "D".

Where the game card device 1 is used in a promotional exercise or competition in which prizes are involved, the number of WINS in each column can determine the amount of any winnings in the competition. Referring now to the embodiment shown in FIG. 3 the game card device 9 embodying the invention shown therein is similar to that shown in FIGS. 1 and 2 in that there are first, second and third indicia all covered by a removable camouflaging layer of rubber/graphite mixture except that the second indicia 10 of the device 9 is in the form of two separate but associated integers which correlate with the first indicia 11. In this case, the first indicia 11 relates to horseracing and the second indicia 10 comprises paired names of jockeys and horses. The third indicia 12 comprises four columns "A", "B", "C" and "D" as in the embodiment of FIGS. 1 and 2, each with an option corresponding with each pair of second indicia 10. Four options in column A are selected to try to match a particular pair with a particular feature of the first indicia 11, for example if the pair in the first line was considered to be good over the distance given against "A" in the first indicia, the space would be uncovered by removing the camouflaging layer 13. If this choice was correct, "WIN" would be shown in the space.

When four options are taken in Column "A", the player moves on to the Column "B", and so on.

As before, the number of WINS in the third indicia 12 indicates the amount of any winnings.

Referring to FIG. 4, the game card device 14 shown therein comprises a paper, cardboard, plastics or other material substratum 15 which is rectangular and can be held as the hand and to which is applied as by printing first, second and third indicia 16, 17 and 18 all of which have spaces which are covered by a removable camouflaging layer 19 for example a rubber/graphite mixture which is adhered to the face of the card 15 as by a heat treatment process but which can readily be removed therefrom with say a finger-nail or edge of a coin.

The first indicia 16 identifies a particular subject and category, in this case TV programmes. The second indicia 17 identifies a number of different integers in the form of a list of television programmes so that those programmes are associated with the first indicia 16, for example Drama content, Humour content, etc. The third indicia 18 provides a plurality of separate options associated with each of the second idicia 17. In the game card device 14 shown, the third indicia 18 comprises five separate vertical as viewed, columns labelled "A", "B", "C", "D" and "E" respectively, each column having a series of numbers against the particular ones of the second indicia 17. There is a grid or matrix 20 of particular numbers on the game card device 14, not covered by a camouflaging layer and forming fourth indicia.

Each game card device 14 fo the TV programme subject thus consists of eight programme titles 17 (as shown) within a defined category. In addition, there are five categories 16 of appeal and quality relevant to the particular section; e.g. for Comedy, the categories could include "HUMOR CONTENT", "ENTERTAINEMENT VALUE" etc. The categories 17 are shown as 5 vertical columns 18 printed beside the 8 TV programme names 16 with the columns horizontally delineated to correspond with the relevant programme names. Each vertical column has 8 spaces on each same card device 14 covered by the scratch-off layer 19. Different numbers would be concealed under each of the 40 spaces. The TV programme names the categories, and the numbers are all concealed under a single scratch-off layer of camouflaging material 19 to maintain security during the packing process and prior to playing the game of skill, the layer 19 having printed instructions thereon.

To play a game of skill using the game card device 14, the contestant first of all, with the aid of a small coin or fingernail, uncovers the subject names and categories 16 and 17 and then attempts to correlate the 16 top ranked programmes 17 for each category 16 relevant to the 8 names shown on the game card device 14 by revealing squares by rubbing off the camouflaging layer over selected spaces of indicia 18. The contestant is allowed to scratch off from only 3 spaces per column 18 without exposing even the smallest part of any additional space. Each correct selection reveals a number. After revealing 15 numbers, the contestant checks and strikes off matching numbers against the 15 numbers shown on the matrix 20 positioned on the card 14 beneath the scratch-off part of the card device 14 game. If *all* of the numbers match, the contestant has a "full house" and can win a share in a Cash Prize Pool.

The categories may be popular music, feature films, or other topics including sporting themes such as tennis, boxing, cricket, football, horse racing, snooker etc. and more serious subjects such as "Britain At Its Best". This could take in famous British Inventors, Scientists, Prioneers, Politicians and Soldiers etc.

It will be understood that the card game devices 1, and 9 shown in the drawings and described herein can be modified. Thus the spaces in the third indicia can show actual amounts to win for example [illegible] if a correct option is taken. Further, the columns in the third indicia can be so arranged that the winnings can be multiplied, for example doubled as the options in each column are taken up. Thus if [illegible] is revealed on a correct decision in column "A", the player has to decide whether to go on to Column "B" with a possibility of doubling his winnings. The skill involved and the chance of winning is controlled by decreasing the number of winning options from left to right in the third indicia.

Further, each individual space 7, 8 say may be camouflaged initially by its own individual camouflaging layer, rather than the game card devices being covered by a "blanket" camouflaging layer as described.

It will also be understood that the rules for playing the game may be printed on the face of the game card devices 1, 9 and 14 opposite the one bearing the indicia. Also, in every embodiment the correct answer for each possible combination of first and second indicia in the third indicia is determined by experts in the particular field of activity prior to printing the game card devices.

I claim:

1. A game card device, for participating in a game of skill comprising:

(i) first indicia applied thereto;

(ii) second indicia applied thereto;

(iii) third indicia applied thereto;

(iv) the first indicia identifying a category or field of activity;

(v) the second indicia identifying a number of different integers associated with the first indicia;

(vi) the third indicia providing a plurality of separate options associated with an association of the first and second indicia;

(vii) an opaque layer camouflaging all of said first, second and third indicia;

(viii) said layer being removable from said first, second and third indicia individually whereby to reveal selected parts thereof.

2. A game card device as defined in claim 1, wherein said camouflaging layer is removable from the whole of said first and second indicia prior to being removed from said third indicia.

3. A game card device as defined in claim 1, wherein said camouflaging layer is removable from the whole of said first and second indicia and wherein said camouflaging layer is removable selectively from said third indicia to reveal only selected parts thereof.

4. A game card device as defined in claim 1, wherein said second indicia comprises a plurality of different but associated indicia.

5. A game card device as defined in claim 1, wherein said second indicia comprises a plurality of associated indicia comprising names of jockeys and horses which would be ridden by the jockeys.

6. A game card device as defined in claim 1, wherein there is a fourth indicia which is not covered by the camouflaging layer and wherein said fourth indicia is associated with said third indicia.

7. A game card device as defined in claim 1, wherein said second indicia comprises a column of eight spaces each bearing the name of separate but related entities and wherein said third indicia comprises a plurality of separate columns of indicia parallel to the first mentioned column for indicating whether the first indicia and second indicia have been associated correctly.

8. A game card device as defined in claim 7, wherein said third indicia comprises a plurality of spaces in each column aligned with the spaces of the second column and each bearing one of two game result options.

9. A game device as defined in claim 7, wherein said third indicia comprises a plurality of spaces in each column aligned with the spaces of the second column and each bearing a number.

10. A game device as defined in claim 7, wherein said third indicia comprises a plurality of spaces in each column aligned with the spaces of the second column and each bearing a monetary value.

11. A game card device as defined in claim 1, wherein said camouflaging layer comprises a mixture of rubber and graphite temporarily secured over said first, second and third indicia.

* * * * *

UNITED STATES PATENT AND TRADEMARK OFFICE

CERTIFICATE OF CORRECTION

PATENT NO. : 4,508,513

DATED : April 2, 1985

INVENTOR(S) : John DONOVAN

It is certified that error appears in the above-identified patent and that said Letters Patent is hereby corrected as shown below:

Please change the Assignee on the front page of the patent to read

DON MARKETING MANAGEMENT LTD.

Signed and Sealed this

*Twenty-fourth* Day of *September 1985*

[SEAL]

*Attest:*

DONALD J. QUIGG

*Attesting Officer*

*Commissioner of Patents and Trademarks—Designate*